US012589271B2

(12) United States Patent
Dondè

(10) Patent No.: US 12,589,271 B2
(45) Date of Patent: Mar. 31, 2026

(54) DEVICE FOR PERFORMING PHYSICAL EXERCISES, IN PARTICULAR FOR MOTOR REHABILITATION EXERCISES

(71) Applicant: LEDRAGOMMA S.R.L., Osoppo (IT)

(72) Inventor: Alessandro Dondè, Osoppo (IT)

(73) Assignee: LEDRAGOMMA S.R.L., Osoppo (IT)

( * ) Notice: Subject to any disclaimer, the term of this patent is extended or adjusted under 35 U.S.C. 154(b) by 120 days.

(21) Appl. No.: 18/567,692

(22) PCT Filed: Jun. 7, 2022

(86) PCT No.: PCT/IB2022/055297
§ 371 (c)(1),
(2) Date: Dec. 6, 2023

(87) PCT Pub. No.: WO2022/259146
PCT Pub. Date: Dec. 15, 2022

(65) Prior Publication Data

US 2024/0278060 A1 Aug. 22, 2024

(30) Foreign Application Priority Data

Jun. 8, 2021 (IT) ..... 102021000014858

(51) Int. Cl.
*A63B 21/008* (2006.01)

(52) U.S. Cl.
CPC ..... *A63B 21/008* (2013.01); *A63B 2213/00* (2013.01); *A63B 2220/56* (2013.01);
(Continued)

(58) Field of Classification Search
CPC ..... A63B 21/008; A63B 2225/74; A63B 2220/833; A63B 2220/56
See application file for complete search history.

(56) References Cited

U.S. PATENT DOCUMENTS 4,883,271 A * 11/1989 French ..... A63B 69/305 482/84
5,755,634 A * 5/1998 Huang ..... A63B 43/00 473/570

(Continued)

FOREIGN PATENT DOCUMENTS

CN 110975238 A * 4/2020 ..... A63B 71/06
CN 115025462 A * 9/2022 ..... A61M 21/02

OTHER PUBLICATIONS

International Search Report for PCT/IB2022/055297 mailed Sep. 19, 2022, 3 pages.

(Continued)

*Primary Examiner* — Joshua T Kennedy
(74) *Attorney, Agent, or Firm* — NIXON & VANDERHYE

(57) ABSTRACT

A device for physical exercise for motor rehabilitation includes a body formed of a casing with at least a part made of a translucent flexible material, the body having an inner chamber and at least one opening, a closing element, housed in the opening, on which at least a pressure sensor, a light source, a control unit and a battery are mounted, in which the pressure sensor is positioned so as to detect the pressure in the inner chamber and in which the control unit is configured to receive the measurement of the pressure value and to control the activation state of the light source according to the parameter.

10 Claims, 4 Drawing Sheets

(52) U.S. Cl.
CPC ..... *A63B 2220/833* (2013.01); *A63B 2225/20* (2013.01); *A63B 2225/74* (2020.08)

(56) References Cited

U.S. PATENT DOCUMENTS

| | | | | |
|---|---|---|---|---|
| 5,888,156 | A | 3/1999 | Cmiel et al. | |
| 9,194,549 | B2 | 11/2015 | Hu | |
| 10,434,376 | B2 * | 10/2019 | Larson | A63B 41/00 |
| 2003/0054923 | A1 * | 3/2003 | Brassil | A63B 23/16 482/49 |
| 2003/0224885 | A1 * | 12/2003 | Leal | A63B 43/06 473/570 |
| 2010/0130315 | A1 * | 5/2010 | Steidle | A63B 41/02 473/610 |
| 2013/0138021 | A1 * | 5/2013 | Mikesell | A63B 23/14 601/40 |
| 2015/0196802 | A1 * | 7/2015 | Siegel | A63B 24/0062 482/8 |
| 2015/0340904 | A1 | 11/2015 | Munson et al. | |
| 2016/0001136 | A1 * | 1/2016 | King | A63B 41/00 320/108 |
| 2019/0038955 | A1 * | 2/2019 | Hansen | A63B 43/00 |
| 2020/0261773 | A1 * | 8/2020 | Ganson | A63B 37/02 |
| 2022/0401797 | A1 * | 12/2022 | Husemeyer | A63B 41/04 |

OTHER PUBLICATIONS

Written Opinion of the ISA for PCT/IB2022/055297 mailed Sep. 19, 2022, 5 pages.

* cited by examiner

DEVICE FOR PERFORMING PHYSICAL EXERCISES, IN PARTICULAR FOR MOTOR REHABILITATION EXERCISES

CROSS-REFERENCE TO RELATED APPLICATIONS

This application is the U.S. national phase of International Application No. PCT/IB2022/055297 filed Jun. 7, 2022 which designated the U.S. and claims priority to IT 102021000014858 filed Jun. 8, 2021, the entire contents of each of which are hereby incorporated by reference.

BACKGROUND OF THE INVENTION

Field of the Invention

The present invention concerns a device for physical exercise, in particular for motor rehabilitation exercises.

Description of the Related Art

In the field of physical and motor activity it is common practice to perform physical exercises in which it is useful, or at times necessary, to have a feedback on the parameters of the movement carried out.

In the field of motor rehabilitation, said parameters are particularly useful to assess the progress of patients during their rehabilitation or in any case to assess the motor condition and ability of a person with a motor deficit.

Various types of machines and devices are available on the market for physical exercise involving the lower and upper limbs and more generally any part of the body.

These devices or machines are often fairly complex and expensive instruments, and are therefore confined to exclusively professional use. Furthermore, due to their high purchase cost, not all centres and/or professionals in the sector are able to equip themselves with one or more of these machines.

Furthermore, there are a number of situations, in the fields of both motor rehabilitation and fitness, in which the physical exercises entail movements and actions that can be carried out with very simple instruments or equipment such as balls, sticks, etc. Normally with these simple and also inexpensive instruments, it is not possible to obtain instrumental data that provide information or parameters relative to the actions such as, for example, forces exerted, movement, etc.

US 2010/130315 A1 describes a bladder for a ball, in particular for the game of football, provided with electronic components. The problem posed is that of connecting electronic components of various types arranged symmetrically in the bladder, in order not to unbalance the ball, avoiding the internal connection wires being damaged by the stress to which the ball is subject. The bladder is provided with a valve, arranged at one pole, which incorporates LEDs of different colour. At the opposite pole of the bladder an electronic component is arranged with a pressure sensor and a battery. The LEDs light up to indicate a correct pressure range for use of the ball. The LEDs on the valve and the electronic component are connected by wiring on the inner walls of the bladder.

U.S. Pat. No. 5,888,156 A describes a ball provided with light sources inside. One embodiment of the ball includes an outer shell with a translucent portion and an inflatable inner bladder arranged inside the outer shell. A lighting element is arranged between the inner inflatable bladder and the outer shell. In another embodiment, the device comprises an outer shell with a translucent portion and an inflatable inner bladder arranged inside the outer shell, with a translucent portion or only an outer shell with a translucent portion. A lighting element has a first portion arranged inside the inner inflatable bladder and a second portion that engages in a sealed manner the inner inflatable bladder or the outer shell. The lighting element comprises a light, a battery, a switch and a wire. The switch consists of an element that can be screwed into the body of the lighting element, designed to press a contact on a pole of the battery to close the circuit.

SUMMARY OF THE INVENTION

In this context, there is therefore the need for a device for physical exercise, in particular for motor rehabilitation, that is simple to use and that provides at least a quality feedback on the movement carried out by the user.

The object of the present invention is therefore to propose a device for physical exercise that overcomes the limits of the known art.

In particular, an object of the present invention is to propose a device that can be gripped with the upper or lower limbs and is designed to provide an indication of the "squeezing" force exerted on the body of the device.

A further object of the present invention is to provide a device that can be used by the user in the same way as the analogous traditional devices.

A further object of the present invention is to offer a device that provides a feedback that can be easily perceived both by the user and by a controller such as, for example, a trainer, a physiotherapist, etc.

Another object of the present invention is to provide a simple and inexpensive device.

Lastly, a further object of the invention is to provide a device that is easy to use, robust and dependable.

The above objects are achieved by a physical exercise device for motor rehabilitation according to claim 1.

According to the invention, the device comprises a body with a casing that defines an inner chamber. The inner chamber can contain pressurized air or if necessary another suitable gas like nitrogen, for example. The casing has at least a part made of translucent or if necessary transparent material and at least a part made of flexible material.

The pressure of the inner chamber is such as to allow the flexible part of the body to maintain its form in a stable manner in the absence of external forces, but at the same time allow said flexible part of the body to be deformed if subject to a squeezing force exerted by a person.

Typically, the pressure of the inner chamber is regulated so that a characteristic dimension of the flexible part (for example the diameter, the length, etc.) is in a range of values near to a reference value.

Preferably said at least one part of the casing is made of a material which is both flexible and translucent. According to a variation of the invention, the entire casing is made of said flexible material which, if necessary, is also completely translucent or transparent.

In the context of the present invention, the definition "translucent" refers to the property of the casing material to allow the passage of light at least in a diffuse manner. The casing material is therefore not completely opaque. Below, for the sake of brevity, the term "translucent", referring to the material, indicates that the same can also be transparent.

The casing has an opening, communicating with the chamber of the body, which houses a closing element that hermetically seals the chamber.

Said closing element comprises a head portion, which acts as a cover for the area provided with the opening, and a support portion, which extends from the head portion towards the inner chamber. One of said parts, preferably the support portion, is designed to couple with the opening of the casing to provide the hermetic seal of the inner chamber.

According to the invention, at least one pressure sensor, a light source, a control unit connected to the light source and to the pressure sensor and a battery that powers the above-mentioned components are mounted on the support portion of the closing element.

The light source is mounted on the support so that, when activated, the light emitted is visible on the outside of the device through the translucent part of the casing.

The pressure sensor is arranged so as to detect the air pressure inside the chamber. The control unit is connected to said pressure sensor and is configured to receive the measurement of the internal pressure measured by the pressure sensor and to control the activation state of the light source according to said value measured.

When the body of the device is subject to an external pressure by the user, for example when it is gripped between the upper or lower limbs, or when it is pressed against a fixed abutment, such as a wall, a floor, a table etc., the internal pressure increases and this variation is picked up by the pressure sensor.

The control unit is configured to change the activation state of the at least one light source, when the internal pressure in the chamber reaches or exceeds one or more predefined pressure values.

Since the light stimulus is visible through the at least one translucent or transparent part of the casing, it performs a feedback function for the user in relation to the pressure or squeezing force exerted on the casing of the device.

The device thus conceived therefore allows information relative to the motor exercise carried out, in particular relative to the force applied to the casing of the device, to be provided to the user in an immediate and intuitive, albeit qualitative, manner.

According to the invention, the form of the body of the device can be chosen from those most suitable according to the mode of use, the type of exercises to be carried out and/or the parts of the body involved. In fact, the device can be gripped with the hands, squeezed between the arms or legs, pressed with the limbs against another part of the body or against an abutment element such as a wall, a surface or the floor.

According to preferable embodiments, the body has a spherical, semi-spherical, cylindrical, disc or oval shape.

The casing can comprise a part made of rigid material such as, for example, plastic or metal, which can act as a supporting base, and a part made of flexible material, subject to manipulation by the user, or, preferably, it can be made entirely of said flexible material.

In the first case, the rigid part and the flexible part are joined so as to guarantee the hermetic seal of the inner chamber.

Suitable materials for the flexible part of the casing are, for example, polyvinyl chloride (PVC) or similar polymer materials.

According to a preferred variation of the invention, the casing of the body is provided with a valve, for example of the type used in sports balls or similar, to allow the internal pressure of the chamber and therefore the rigidity of the flexible part of the casing to be varied.

Alternatively, the valve can be applied directly on the closing element.

As said previously, the casing can be partly translucent or transparent, thus allowing the light emitted by the light source to be seen from the outside, or it can be made entirely of said material.

According to an aspect of the invention, the device is furthermore equipped with a communication module, preferably of Bluetooth type, connected to the control unit.

Through said communication module the device can communicate with an external device, for example a mobile device or a computer or a dedicated accessory, to exchange data, for example transfer the data acquired by the pressure sensor.

If the control unit is of programmable type, through said communication module it can exchange data with an external device with which it is possible to program the interaction between the control unit and the light source according to the pressure value detected by the pressure sensor.

Preferably, the control unit is configured to program the use of the device according to instructions provided by the user (calibration of device, type of exercise, quantities to be considered—pressure/force, acceleration—etc.) through the external device, for example by means of an application on a smartphone or tablet.

Additionally or alternatively, according to another aspect of the invention, the control unit is configured to activate a given operating mode, for example the calibration mode (described below) or the exercise mode, according to the number of movements detected performed by the user, for example a number of pressure actions carried out in sequence on the device.

This mode allows the user to interact with the device independently without requiring the external electronic device.

According to the invention, the light source can comprise one or more light elements, typically LEDs, that produce monochrome light or light of different colours.

According to one aspect of the invention, the control unit can be configured to control the blinking of the light source (number of blinks, duration and frequency) or activation of the various colours to transmit to the user or to the controller feedback information on the exercise in progress. For example, a certain number of blinks or a given colour can indicate a level of pressure/force reached by the user, or a particular functioning state of the ball (for example the beginning or the end of the calibration process or battery low).

The setting parameters of the device can be in the form of a control map, which can be predefined and preloaded in the control unit or programmed via an external device.

The control unit can furthermore be configured to control the light source in the way described above to provide instructions to the user or to the controller in relation to the exercise to be carried out also when the device is not in use, namely not squeezed by the user.

According to one aspect of the invention, the control unit comprises an operating mode which entails detecting the pressure value $P_0$ inside the chamber when the body of the device is not squeezed. The control unit can be configured to signal, commanding activation of the light source, whether said initial pressure value is outside a set optimal operating range.

Said initial value is generally detected in an initial phase at start-up of the device.

According to a preferred embodiment, the control unit is configured to detect the compression/squeezing force exerted by the user as the difference between the pressure value P detected by the pressure sensor during the exercise and the initial value $P_0$.

According to a possible embodiment, the control unit can include a calculation function of the force exerted by the user. Said force calculation function can be linked to a calibration curve stored in the control unit.

According to one aspect of the invention, the control unit can be configured to store and set a threshold or reference pressure value $P_x$ (or force) that can be exerted by a given user or which, if necessary, must not be exceeded during the exercise.

Said value is generally recorded prior to the beginning of the exercises. According to this variation, a calibration function is implemented according to which the user is requested to compress the body of the device with the greatest force possible or with a given level of force, and the relative threshold pressure value $P_x$ is recorded by the control unit. According to this variation, the control unit is configured to control activation of the light source to signal, with a colour or a given sequence of blinks or a given light intensity, the entity of the pressure value P detected, according to the threshold value $P_x$ stored.

According to another aspect of the invention, the device can comprise an ambient light sensor. According to said variation, the control unit is configured to manage the light intensity generated by the light source, modulating it according to the ambient light perceived inside the casing. In this way, it would be possible to fine-tune management of the power consumption of the lighting part.

According to another aspect of the invention, the device can be equipped with a movement sensor, preferably an accelerometer or equivalents.

Said sensor is connected to the control unit, which can be configured to control the light source also according to the parameters measured by said movement sensor. The parameters of the movement can also be sent to an external device through the communication module.

According to another aspect of the invention, the device for physical exercise can be equipped with a battery recharge circuit. According to a preferred variation, said recharge circuit comprises a winding made of electrically conductive material that can be operatively associated with an inductive recharge device. Said winding is located in the closing element, preferably in the head portion. Alternatively, the recharge circuit can comprise contacts positioned on the head portion of the closing element and accessible from the outside.

According to another aspect of the invention, the device for physical exercise can be supplied in a kit also comprising a support element on which the device can be rested when not in use.

The support comprises a housing in which the device for physical exercise is partially housed and can be provided with retention means, for example magnetic or interlocking, designed to couple with corresponding retention means on the device to maintain its position stable when it is rested on the support.

According to another aspect of the invention, said support can be provided with power supply means for charging the battery of the device. Preferably said recharge means are of inductive type, where the device is equipped with a corresponding inductive or electric contact recharge circuit.

In the variation in which the device for physical exercise is provided with the communication module, also the support can be equipped with a control unit and with a communication module configured to exchange data with the control unit of the device, for example to receive from the device the data collected by the pressure sensor and by the movement sensor, if present. For said purpose, the control unit of the support is preferably provided with a memory module.

In the variation in which the control unit of the device for physical exercise is of programmable type, it can be programmed directly by the control unit of the support, for example in order to load programs for exercises dedicated to the user and/or to set operating parameters, for example to set the threshold pressure value $P_x$ and to associate with lower or intermediate pressure values a given combination of blinking or colour of the light source.

BRIEF DESCRIPTION OF THE DRAWINGS

Further characteristics and advantages of the present invention will appear clearer from the description of a possible embodiment example of a device for physical exercise, as illustrated in the attached figures in which.

DETAILED DESCRIPTION

Figure 1:
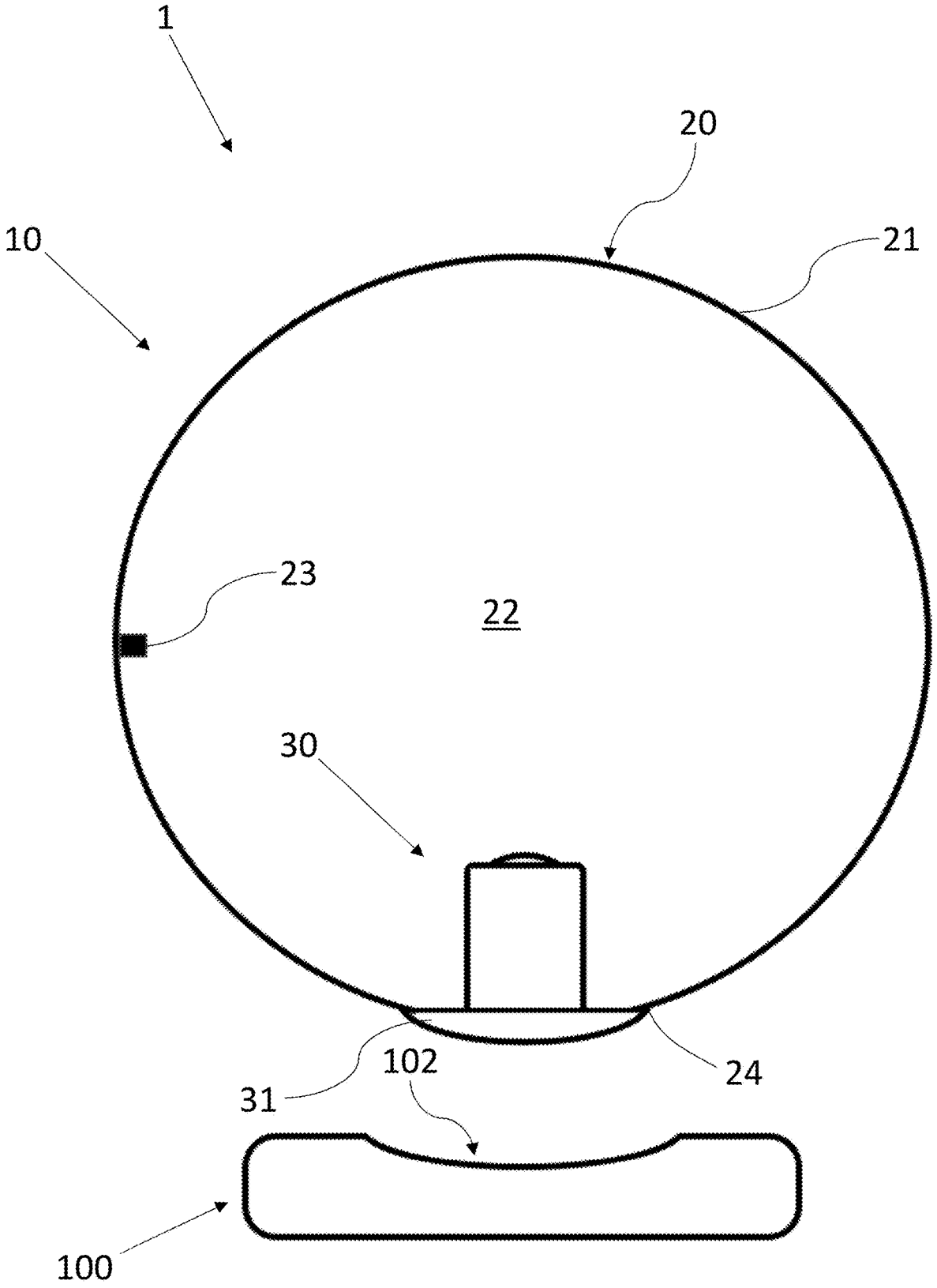
FIG. 1 is a schematic view in lateral section of the device for physical exercise according to the present invention.

With reference to the attached figures, the number 1 indicates overall a kit comprising a device for physical exercise 10 and a support 100 where the device is rested when not in use.

The device comprises a body 20 formed of a casing 21 made of polyvinyl chloride, or similar materials, translucent or transparent.

In the example illustrated, the body 20, in the condition of use, namely when the value of the pressure in the inner chamber 22 is within a suitable range, has the form of a sphere. As mentioned above, however, the body 20 can be semi-spherical, oval or any other shape suitable or useful for carrying out physical exercises for fitness or rehabilitation. The casing 21 is preferably provided with a valve 23 to introduce or discharge air, or if necessary another suitable gas, into/from the inner chamber 22.

In the body 20, and more precisely in the casing 21, a circular opening 24 is obtained in which a closing element is housed indicated overall by 30.

Figure 2:
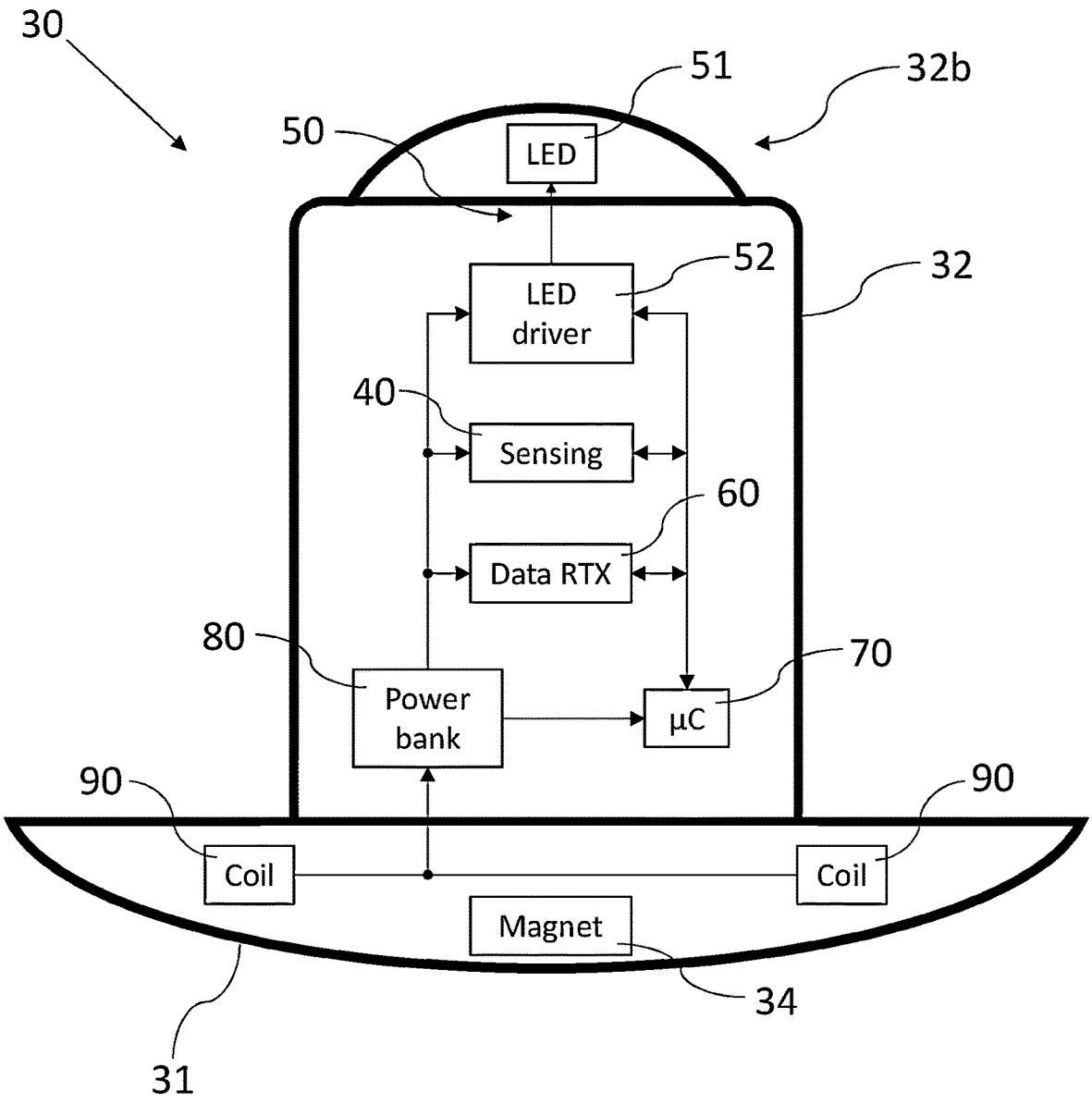
FIG. 2 is a schematic view in lateral section of a detail of FIG. 1.

With reference to FIG. 2, the closing element 30 comprises a head portion 31 and a support portion 32. An area of the support element 32, near to the head portion 31, is designed to couple with an edge of the opening 24 so as to guarantee that the inner chamber 22 is airtight. Said airtight coupling is preferably obtained by means of a shape coupling without the use of sealants, adhesives or similar.

The support portion 32 develops, from the head portion 31, towards the inside of the chamber 22.

Said closing element 30 is typically made of a preferably rigid polymer material.

On said support portion 32 the following components are mounted: at least one pressure sensor 40, at least one light source 50, a communication module 60, a control unit 70, connected to the light source, to the pressure sensor and to the communication module, and a battery 80 that powers the above-mentioned components.

The light source 50 is preferably positioned in the area of an end 32*b* of the support 30 so that the light beam emitted is diffused as uniformly as possible inside the chamber. The translucent material of the casing 21 contributes to creating a diffuse effect of the light over the entire surface of the casing.

Preferably the light source 50 comprises one or more LEDs 51 of RGB or RGBW type so as to generate light of different colours. Typically the light source 50 further comprises a driver circuit 52 of the LEDs 51.

The communication module 60 preferably operates via Bluetooth, Wi-Fi, NFC or other wireless communication standards.

According to a preferred variation, in the area of the head portion 31 of the closing element 30 a recharge circuit 90 is mounted comprising a loop or coil, made of copper or equivalent materials, connected to the battery 80.

Figure 3:
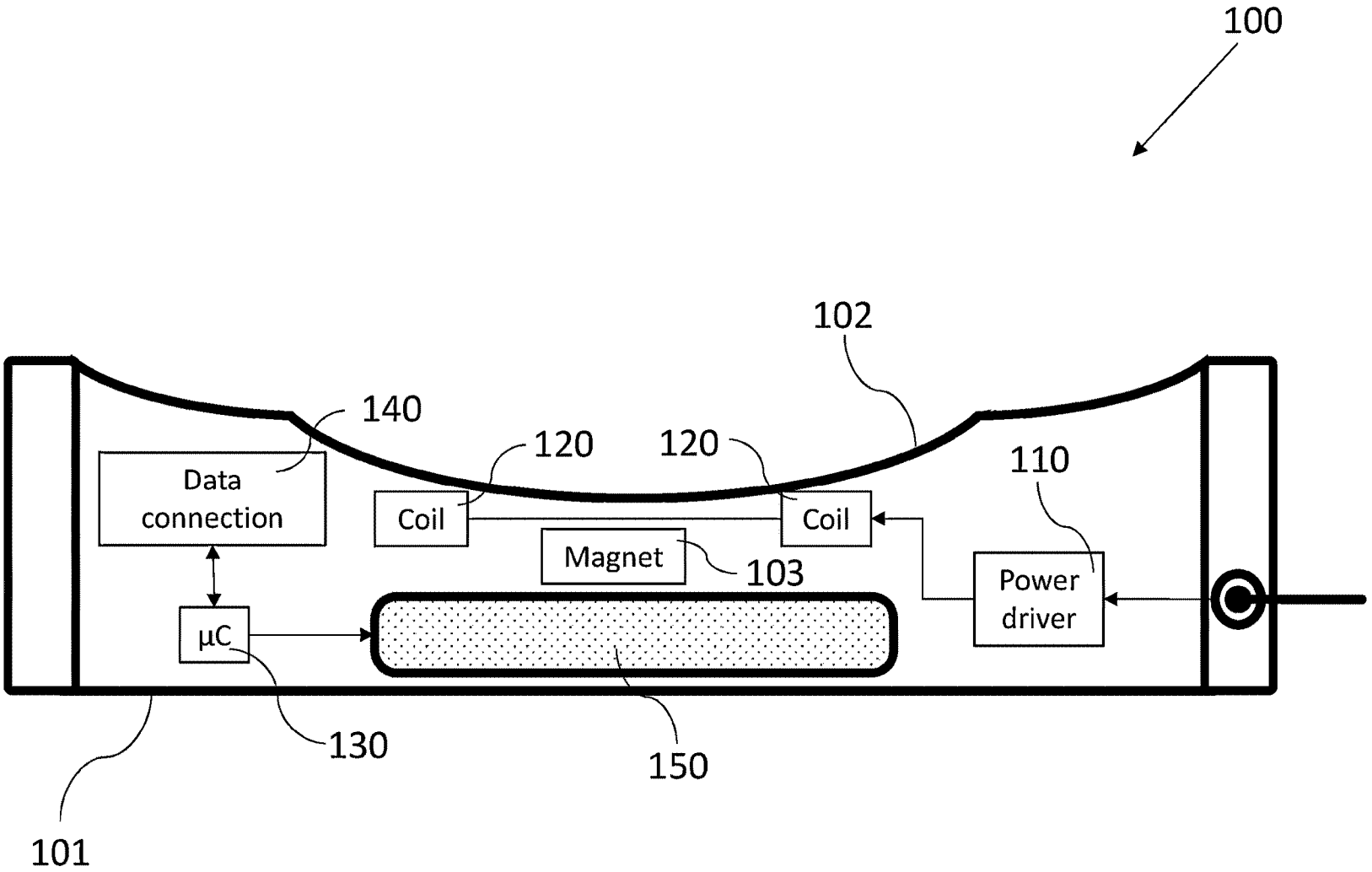
FIG. 3 is a schematic view in lateral section of a support and recharge element for the device of FIG. 1.

In FIG. 3 the support 100 for the device for physical exercise 10 is shown in greater detail, albeit schematically.

Said support 100 comprises a base 101 with a seat 102 in which the device 10 can be housed. In the example illustrated, the seat 102 forms a hollow in which the body 20 of the device 10 is partially housed.

The support 100 is equipped with a current drive device 110 that can be connected to an external electric power supply, designed to power the electronic components mounted on board the support.

In greater detail, the support is provided with a power supply circuit 120 comprising a loop or a coil positioned in the area of the seat 102. When the device 10 is resting on the support 100, the closing element 30 faces towards the seat 102 of the support so that the two loops/coils of the respective power supply 120 and recharge 90 circuits are at an optimal distance, approximately 2-5 mm, such that the magnetic field generated by one interacts with the other.

The support 100 further comprises a control unit 130 connected to a communication module 140, preferably wireless of the above-mentioned types. Preferably the support further comprises an input/output interface 150 of the control unit 130. Said interface 140 preferably comprises a touch-screen display that allows operating parameters of the device 10 to be set, where the latter is provided with a programmable control unit, and also allows useful information to be displayed such as the battery charge level, the initial pressure $P_0$ in the inner chamber 22 and also the parameters of the exercise in progress in real time.

Preferably in the area of the seat 102 of the support 100, a magnet 103 is provided designed to interact with a respective magnet 34 positioned in the head portion 31 of the closing element 30.

Figure 4:
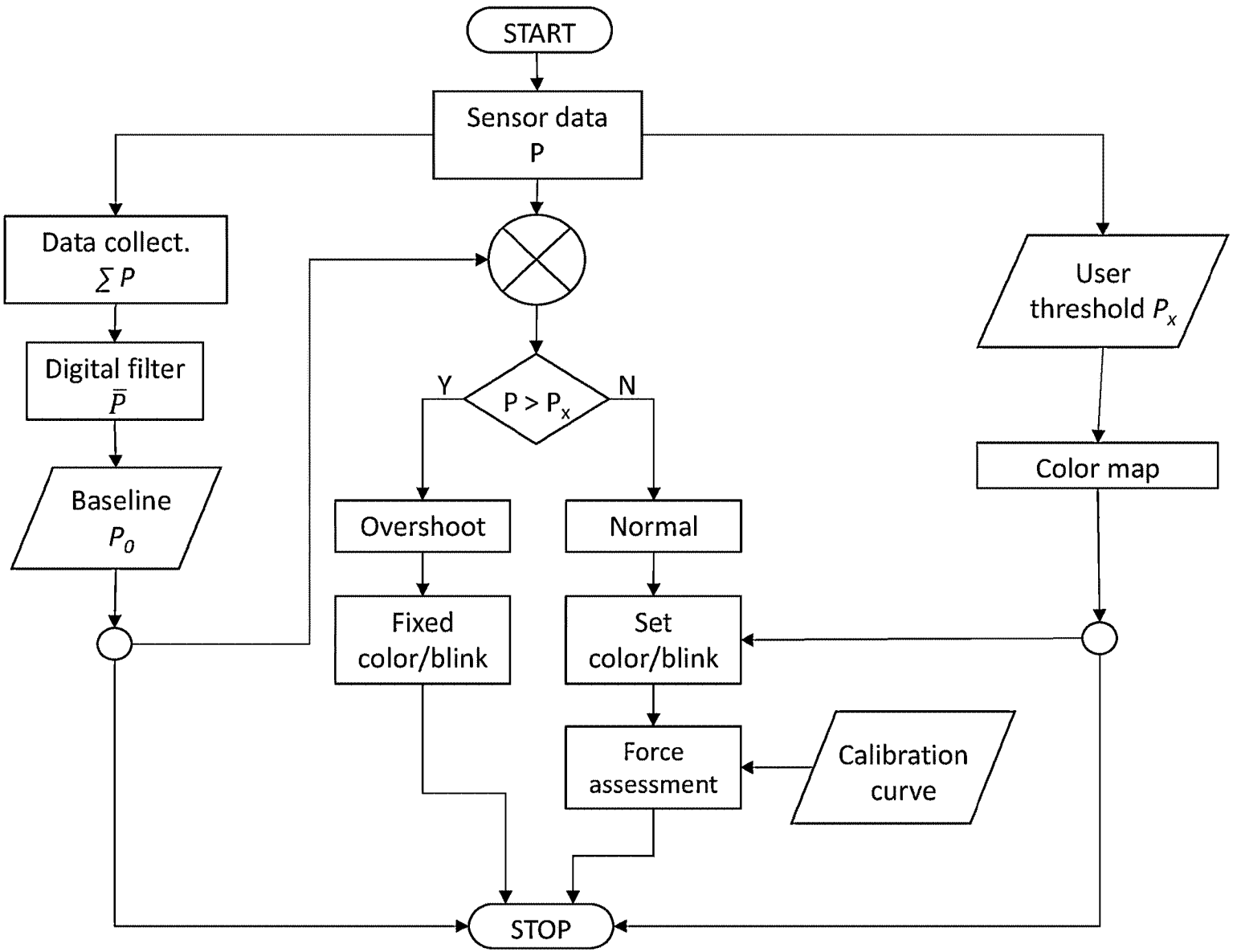
FIG. 4 shows a block diagram that illustrates the operation of the device according to the present invention.

With reference to FIG. 4 a block diagram is shown that illustrates, purely by way of example, the operation of a device for physical exercise according to a possible variation of the invention.

At start-up of the device, the control unit calculates the initial internal pressure $P_0$. Preferably, said value is measured by calculating the mean of the pressure values detected by the pressure sensor in a pre-defined time interval after start-up of the device. Preferably, said values are appropriately filtered to reduce the error margin due to the values at the extremes.

The initial pressure value $P_0$ is stored in the control unit of the device.

Once detection of the initial pressure has been completed, the device is ready for setting of the threshold pressure $P_x$. According to a possible embodiment, the threshold pressure is measured during a cycle or a repetition of an exercise carried out by the user, or following a specific calibration command given by means of the input/output interface. In this phase, the user will apply his/her maximum force or a lesser force according to the type and purpose of the exercise. The maximum pressure value reached is stored by the control unit as threshold value $P_x$.

According to said threshold value and the pressure value P measured in a given instant, the control unit is programmed to control the light source. In the example illustrated, the control unit comprises a programmed map (colour map) on the basis of which it can control switch-on of the light source with a given colour according to the percentage of the pressure value P with respect to the threshold value $P_x$. This map can be fixed, namely preloaded in the control unit, or it can be programmable if the control unit is of programmable type.

Where the light source is monochrome, said map can comprise different blinking sequences thereof and/or different lighting intensity of the source.

During performance of the exercise by the user, if the pressure value P detected in a given instant is higher than the threshold value $P_x$, the control unit can generate a signal through the light source to inform the user accordingly. The signal is in the form of a given colour or blinking of the light source previously known to the user.

If the pressure value P detected is lower than the threshold value $P_x$, the control unit commands activation of the light source based on the preloaded or programmed map, in order to provide the user and/or the controller with a qualitative feedback on the pressure/squeezing force applied to the body of the device.

If scheduled, the control unit can comprise a calculation function to calculate the instantaneous value of the force applied to the body of the device by means of a calibration curve.

The above is a purely indicative example of a possible embodiment of the device. As mentioned above, the device can comprise further accessory functions such as, for example, providing instructions to the user on the exercise to be carried out, again by use of the light source as a message carrier, or measuring and presenting also other movement parameters of the device.

The present invention has been described for illustrative non-limiting purposes, according to some preferred embodiments. A person skilled in the art will find numerous other embodiments, all falling within the protective scope of the following claims.

The invention claimed is:

1. A device for physical exercise, comprising:

a body with a casing that defines an inner chamber configured to be filled with a pressurized gas, said casing comprising at least a part that is a translucent or transparent material and at least a part that is a flexible material, said body having at least an opening, communicating with the inner chamber;

a closing element housed in the opening configured to couple with the opening of the casing, said closing element comprising a head portion and a support portion extending from the head portion towards the inner chamber; and a plurality of components mounted on the support portion, the components comprising at least one pressure sensor positioned to detect a value of a pressure in the inner chamber, at least one light source, a controller connected to the at least one light source and the at least one pressure sensor, the controller being configured to receive a measurement of the pressure value and to control an activation state of the at least one light source according to the pressure value, the controller being configured to store and set a threshold pressure value, the controller comprising an initial calibration function to record said threshold pressure value prior to a beginning of exercise, said threshold pressure value corresponding to a greatest compression force exerted by a user or a specific level of compression force exerted by the user, the controller being configured to control, during use of the device, activation of the at least one light source in order to signal, with one of a specific color, a specific sequence of blinks, and a specific light intensity, an entity of the pressure value detected according to the stored threshold pressure value, and a battery that powers the components.

2. The device according to claim 1, wherein said casing is partly or entirely the flexible material, the flexible material being translucent.

3. The device according to claim 1, further comprising a communication system connected to the controller.

4. The device according to claim 1, wherein the controller comprises a control map, said controller being configured to control activation of the at least one light source according to the detected pressure value detected and parameters of said control map.

5. The device according to claim 4, wherein the light is RGB or RGBW LED, and wherein the controller is configured to drive the color emitted by the at least one light source according to the parameters of the control map or the threshold pressure value.

6. The device according to claim 1, wherein the controller is programmable.

7. The device according to claim 1, wherein the controller includes a calculation function of the force exerted on the body of the device according to the detected pressure value detected, said calculation function including a calibration curve stored in the controller.

8. The device according to claim 1, further comprising a recharge circuit for the battery that includes at least a coil or loop of conductive material located in the head portion of the closing element or electric contacts protruding from an outer surface of said head portion.

9. A kit comprising:

the device for physical exercise according to claim 8; and a support for said device, the support comprising a body configured to receive or house at least part of the body of the device when not in use, said support further comprising a power supply circuit configured to recharge the battery of the device.

10. A kit comprising:

a device for physical exercise comprising:

a body with a casing that defines an inner chamber designed to be filled with a pressurized gas, said casing comprising at least a part that is a translucent or transparent material and at least a part that is a flexible material, said body having at least an opening, communicating with the inner chamber, a closing element housed in the opening and configured to couple with the opening of the casing, said closing element comprising a head portion and a support portion extending from the head portion towards the inner chamber, and a plurality of components mounted on the support portion, the components comprising at least one pressure sensor positioned to detect a value of a pressure in the inner chamber, at least one light source, a first controller connected to the at least one light source and the at least one pressure sensor, the first controller being programmable, the first controller being configured to receive a measurement of said pressure value and to control an activation state of the at least one light source according to said pressure value, the first controller being configured to store and set a threshold pressure value, the first controller comprising an initial calibration function to record said threshold pressure value prior to a beginning of exercise, said threshold pressure value corresponding to a greatest compression force exerted by a user or a specific level of compression force exerted by the user, the first controller being configured to control, during use of the device, activation of the at least one light source in order to signal, with one of a specific color, a specific sequence of blinks, and a specific light intensity, an entity of the pressure value detected according to the stored threshold pressure value, a first communication system connected to the first controller, a battery that powers the components, and a recharge circuit for the battery that includes at least a coil or loop of conductive material located in the head portion of the closing element or electric contacts protruding from an outer surface of said head portion; and a support for the device, the support comprising a second controller, and a second communication system that is wireless, said second controller being configured to communicate with the first controller of the device and to program operating parameters of the first controller; and a support for the device.

* * * * *